US007487695B2

(12) United States Patent
Sommerfeld et al.

(10) Patent No.: US 7,487,695 B2
(45) Date of Patent: Feb. 10, 2009

(54) RELEASE HOLDING MECHANISM FOR ASR HAND BRAKE

(75) Inventors: Howard Sommerfeld, Oak Forest, IL (US); Scott Natschke, Chicago, IL (US)

(73) Assignee: WABTEC Holding Corp., Wilmerding, PA (US)

( * ) Notice: Subject to any disclaimer, the term of this patent is extended or adjusted under 35 U.S.C. 154(b) by 794 days.

(21) Appl. No.: 10/873,967

(22) Filed: Jun. 22, 2004

(65) Prior Publication Data

US 2005/0279184 A1 Dec. 22, 2005

(51) Int. Cl.
*G05G 1/08* (2006.01)

(52) U.S. Cl. ..... 74/506

(58) Field of Classification Search ..... 74/505, 74/506, 507, 552, 556; 192/95, 114 R, 89.21; 188/124, 130

See application file for complete search history.

(56) References Cited

U.S. PATENT DOCUMENTS 1,599,046 A * 9/1926 Good ..... 192/24
3,390,590 A * 7/1968 Natschke et al. ..... 74/505
3,620,098 A * 11/1971 Natschke ..... 74/465
3,625,086 A * 12/1971 Natschke ..... 74/505
3,668,944 A * 6/1972 Natschke ..... 74/505
3,854,417 A * 12/1974 MacDonnell et al. .... 105/463.1
4,282,771 A * 8/1981 Grube ..... 74/505
4,291,793 A 9/1981 Klasing
4,368,648 A 1/1983 Housman et al.
5,127,283 A * 7/1992 O'Brien et al. ..... 74/505
6,179,093 B1 * 1/2001 Daugherty, Jr. ..... 188/33
6,325,465 B1 * 12/2001 Sommerfeld et al. ..... 303/13
6,364,428 B1 * 4/2002 Labriola et al. ..... 303/13
7,021,430 B2 * 4/2006 Ring et al. ..... 188/33
7,093,694 B2 * 8/2006 Brandt et al. ..... 188/1.11 R
2004/0188195 A1 * 9/2004 Ring et al. ..... 188/185

* cited by examiner

*Primary Examiner*—Vicky A Johnson
(74) *Attorney, Agent, or Firm*—James Ray & Associates

(57) ABSTRACT

A hand brake having mechanism for retaining the hand brake in a substantially released and hold position to prevent unwanted application of the railway car brakes due to vibration or other energy sources during railway car motion. Such mechanism includes at least one spring mounted to the hand brake housing substantially engaging a release lever disposed within a quick release mechanism so as to prevent reverse rotation of the release lever causing an unintended take-up of the chain.

15 Claims, 6 Drawing Sheets

RELEASE HOLDING MECHANISM FOR ASR HAND BRAKE

CROSS-REFERENCES TO CO-PENDING APPLICATION

This application is related to co-pending U.S. Ser. No. 10/873,958 entitled "Mechanical Release Of Release Holding Mechanism For Hand Brake", filed with the U.S. Patent Office on Nov. 17, 2005. Said application being assigned to the assignees of the present invention and disclosure of this co-pending application is hereby incorporated by reference thereto.

FIELD OF THE INVENTION

The present invention relates, in general, to hand brake assemblies for use on railway type vehicles and, more particularly, this invention relates to a hand brake assembly equipped with a quick release mechanism.

BACKGROUND OF THE INVENTION

Railway car hand brake mechanisms are well known in the railway art. They usually include a relatively large, rotatable hand wheel disposed in a vertical plane and mounted on a shaft which, through a gear train, can rotate a chain drum to wind up a chain that is secured at its end remote from the chain drum to the brake rigging of the railway car. As the hand wheel is rotated in one direction, the brakes are applied and rotation of the hand wheel shaft in the opposite direction is prevented by a pawl which engages a detent wheel on the hand wheel shaft.

These hand brake mechanisms provide a clutch mechanism for facilitating gradual release of the brake. When a hand wheel is rotated clockwise (as viewed from the front of the unit), such rotation is transmitted directly through a drive shaft, a pinion, a gear, and a winding drum to take up slack of a chain connected to the brake rigging. When resistance is offered by the chain to further rotation of the hand wheel, such resistance, acting back through the drum, the gear, and pinion, causes a nut to be advanced on a threaded portion of the drive shaft to move against a ratchet member which is clamped between respective friction surfaces on the nut and on the drive shaft, thus causing the drive shaft, ratchet, and the nut to rotate as a unit. A pawl prevents rotation of the ratchet in the opposite direction. The hand wheel torque is increased until a state of static equilibrium is reached, or at the point at which the brakes are fully applied, whereupon rotation of the hand wheel is terminated, and the clamped ratchet, by means of the holding pawl, prevents the chain from unwinding.

The clutch mechanism also provides for quick release of the brakes by operating a release handle which effects disengagement of the normally engaged clutch and thereby allows free rotation of the pinion and gear to release the chain load while the nut and ratchet are held stationary by the holding pawl. The brakes may be released by disengaging the pawl from the detent wheel but this causes rapid rotation of the hand wheel and the gears of the gear train. To avoid rapid rotation of the hand wheel, hand brake mechanisms have been devised which are known as "quick release" mechanisms. U.S. Pat. No. 4,368,648 titled "Hand Brake for Railroad Car" teaches such a hand brake having a quick release mechanism. Such quick release mechanism includes a releasable connecting means between the hand wheel shaft and the gear train. When the connecting means is released, the gears of the gear train rotate rapidly, without constraint by the pawl and detent wheel, but the hand wheel remains stationary. The teachings of U.S. Pat. No. 4,368,648 are hereby incorporated into the present application by reference thereto.

It has been found that when a hand brake is released, either by mechanical or pneumatic means, such releasable connecting means between the hand wheel shaft and the gear train do not remain in released position due to the vibration, or other unknown energy generated during train operation. As a result the brakes may be applied unintentionally during railway vehicle motion when the chain of the hand brake does not have enough slack to overcome partial release.

SUMMARY OF THE INVENTION

A hand wheel in a handbrake mechanism for a railway car is used to rotate a gear wheel to apply the brakes. Such handbrake having a housing with a back wall and a front wall, with a chain winding drum and a main gear wheel rotatably mounted on a drum shaft thereon. Such hand wheel having a shaft rotatably mounted on the housing having a bearing section at a first end and a hand wheel receiving section on a second end external to such housing. A ratchet wheel is mounted on a hand wheel shaft and rotatable with such hand wheel shaft intermediate the first and second ends thereof. A holding pawl in such housing cooperates with the ratchet wheel so as to prevent reverse rotation thereof. Additionally, a freely rotatable pinion on the hand wheel shaft engages the main gear wheel. The pinion has a radially extending flange cooperating therewith. A quick release mechanism cooperates with the holding pawl to allow reverse rotation of the ratchet wheel for releasing the chain. The hand brake further includes a leaf spring means to substantially engage release lever arm during hand brake application. When the hand brake is released, the release shaft rotates, radially moving the lever arm into engagement with the leaf spring which is attached to the inside of the housing. When the release shaft reaches full release, the load of the leaf spring holds the release shaft in this position until it is mechanically rotated out of position.

OBJECTS OF THE INVENTION

It is therefore one of the primary objects of the present invention to provide a hand brake which provides a means to substantially maintain the hand brake in the released position.

It is a further object of the present invention to provide a hand brake which prevents unintentional application of the braking apparatus during the rail car motion around a curve.

It is another object of the present invention to provide a hand brake which prevents wheel sliding on the rail when the rail car is moving at a substantially high speed due to unintentional brake application.

It is still a further object of the present invention to provide a hand brake which provides a more reliable operation.

It is an additional object of the present invention to provide a hand brake having means to substantially maintain the hand brake in the released position which is easily convertible for use with the presently disclosed automatic activation hand brake.

Although a number of objects and advantages of the present invention have been described in some detail above, various additional objects and advantages of the hand brake mechanism of the present invention will become more readily apparent to those persons who are skilled in the art from the following more detailed description of the invention, particularly when such detailed description of the invention is taken in conjunction with both the attached drawing figures and with the appended claims.

DETAILED DESCRIPTION OF THE INVENTION

Figure 1:
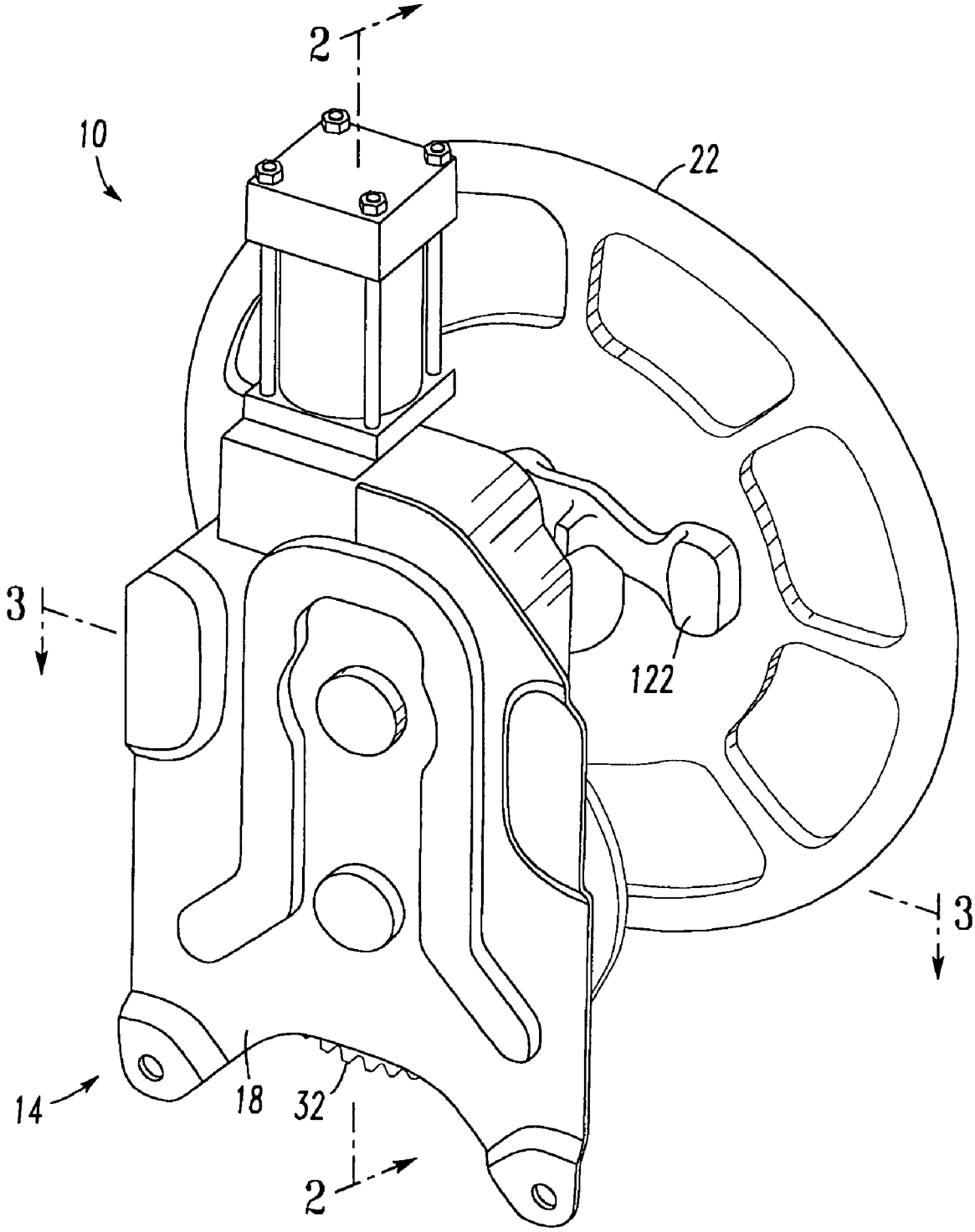
FIG. 1 is a perspective view of a hand brake assembly of a presently preferred embodiment of the invention.

The following background information is provided to assist the reader to understand the environment in which the invention will typically be used. The terms used herein are not intended to be limited to any particular narrow interpretation unless specifically stated otherwise in this document.

Prior to proceeding to the more detailed description of the various embodiments of the present invention, for the sake of clarity and understanding of such invention, it should be noted that identical components having identical functions have been identified with identical reference numerals throughout each of the figures illustrated herein.

Figure 2:
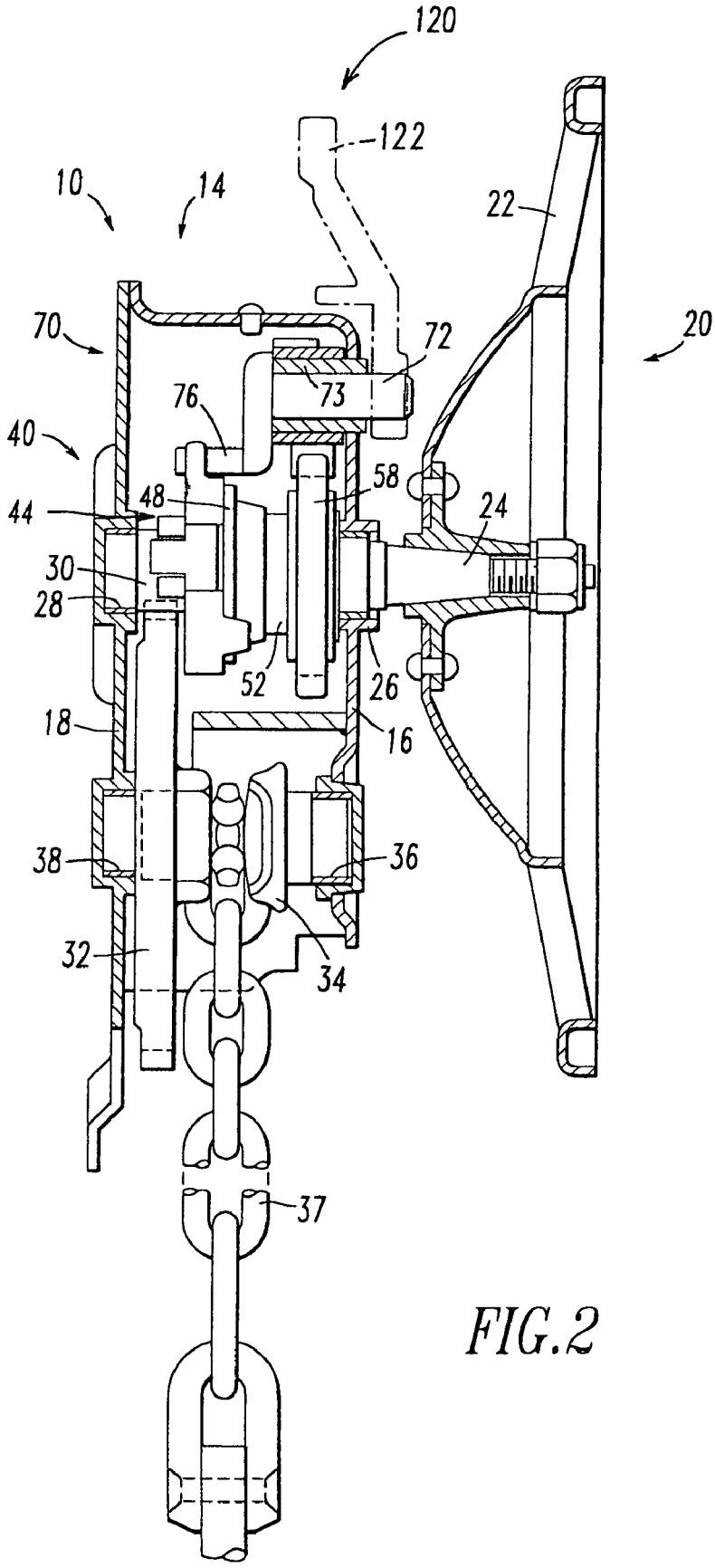
FIG. 2 is a cross-sectional view of the hand brake assembly, taken along the lines 2-2 of FIG. 1 showing a chain component.

A hand brake, generally designated 10, for railroad cars embodying the invention, as shown in FIGS. 1 and 2, includes a housing, generally designated 14, having a front plate 16 and a back plate 18. A driving mechanism, generally designated 20, is disposed in the upper portion of housing 14. Such driving mechanism having a hand wheel 22 secured to a drive shaft 24. The drive shaft 24 being journaled for rotation in bearings 26 and 28 secured in front plate 16 and back plate 18, respectively.

Drive shaft 24 has secured thereon for rotation therewith, at the end adjacent bearing 28, a pinion 30 which engages a gear 32 for rotating a chain drum 34 journaled for rotation in bearings 36 and 38 secured on front plate 16 and back plate 18, respectively, in the lower portion of housing 14. Chain drum 34 engages alternate links of a chain 37 for taking-up the chain.

Figure 3:
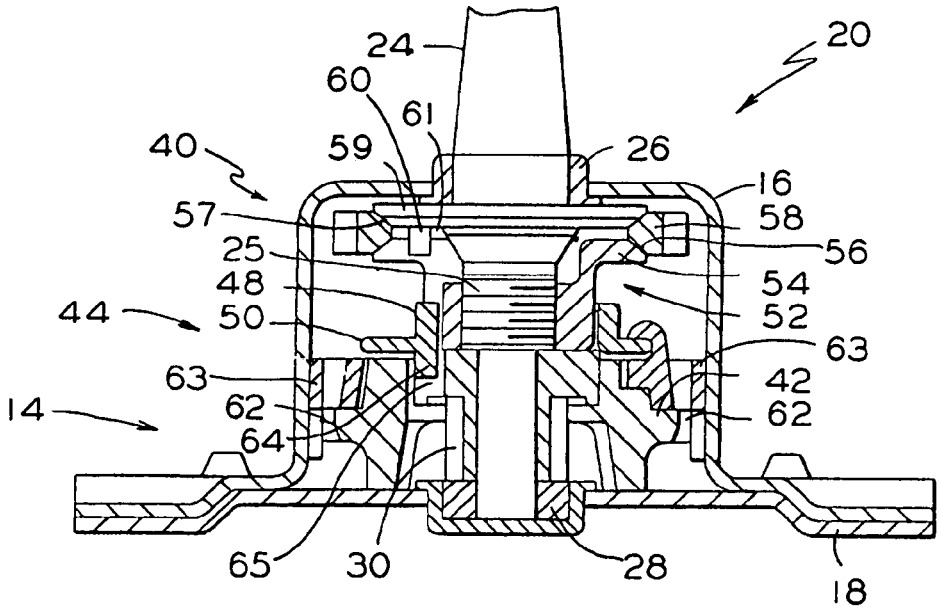
FIG. 3 is a cross-sectional view of the hand brake assembly, taken along the lines 3-3 of FIG. 1 showing a clutch and release mechanism.

Also disposed in the upper portion of housing 14 and associated with the driving mechanism, is a clutch and quick release mechanism, generally designated 40, which may best be seen in FIG. 3. The clutch and quick release mechanism 40 includes an annular stationary cam member 42 restrained from both axial and rotational movement, and a movable cam member, generally designated as 44, rotatably disposed concentrically within stationary cam 42. The movable cam 44 being rotatable relative to the stationary cam member 42 by means of complementary fast pitch threads (not shown) formed thereon.

An internally splined annular clutch collar 48 is provided with an annular flange 50 and concentrically surrounds the drive shaft 24. The collar 48 engages with an externally splined nut, generally designated 52, attached to threaded portion 25 of such shaft 24. Nut 52 includes a flange 54 with an annular friction surface 56 for making abutting contact with one side of a ratchet wheel 58, the other side of the ratchet wheel 58 being abuttable with a friction surface 57 of a friction plate 59 concentrically secured to shaft 24 adjacent bearing 26.

Figure 6:
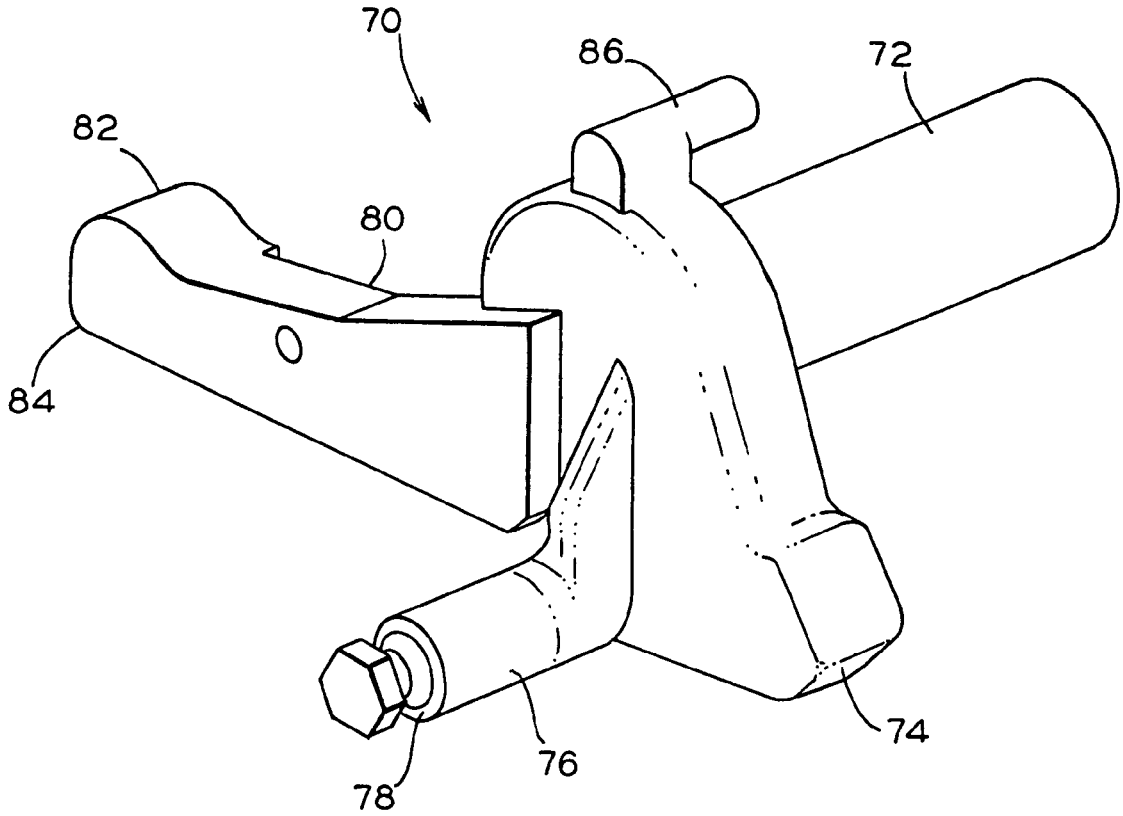
FIG. 6 is a perspective view of the release lever of the present invention.
Figure 4:
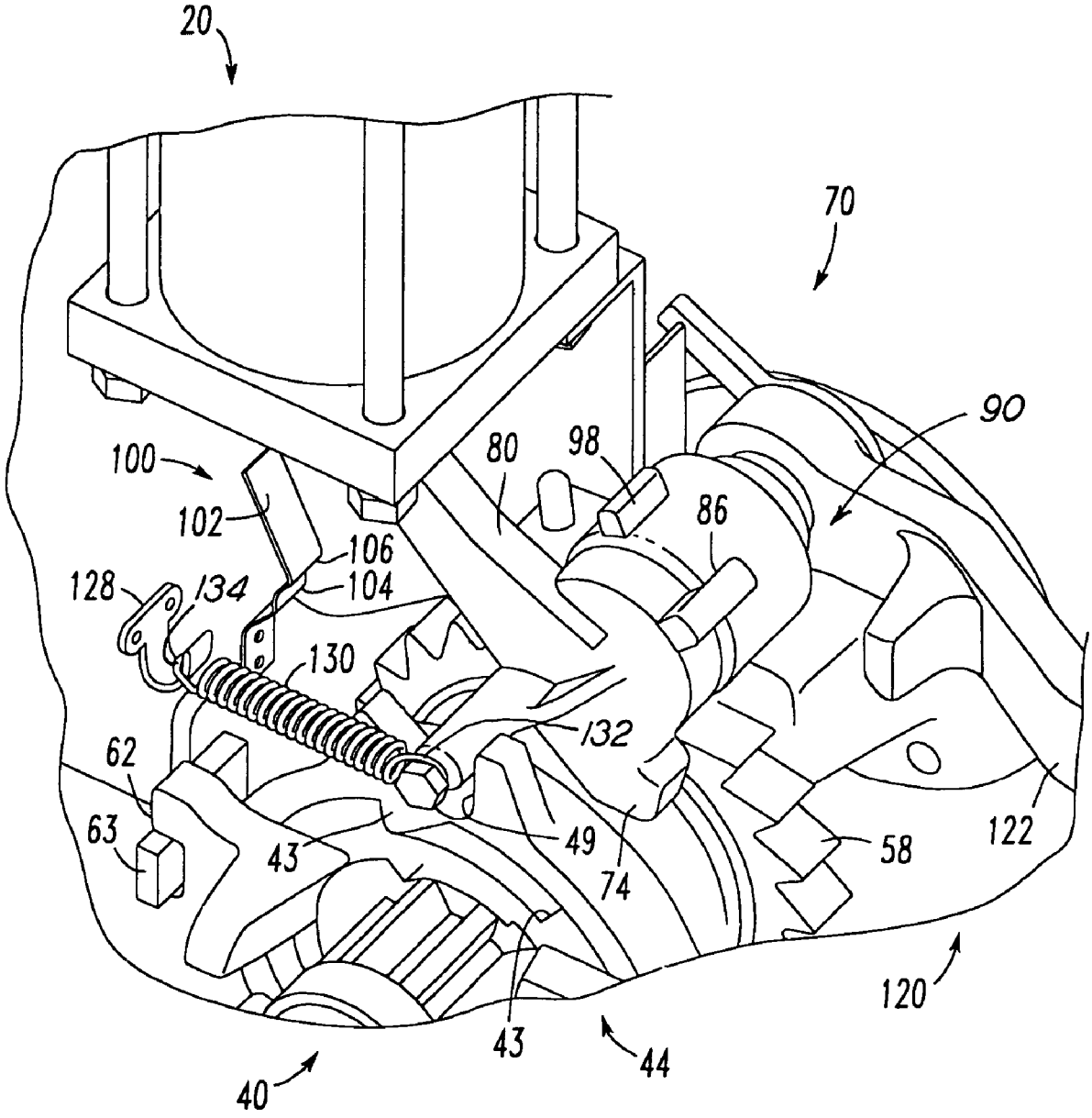
FIG. 4 is a cut-away perspective view of a hand brake assembly of the present invention, particularly showing the release lever of the present invention engaged with the spring means when the hand brake is in a released and hold position.
Figure 5:
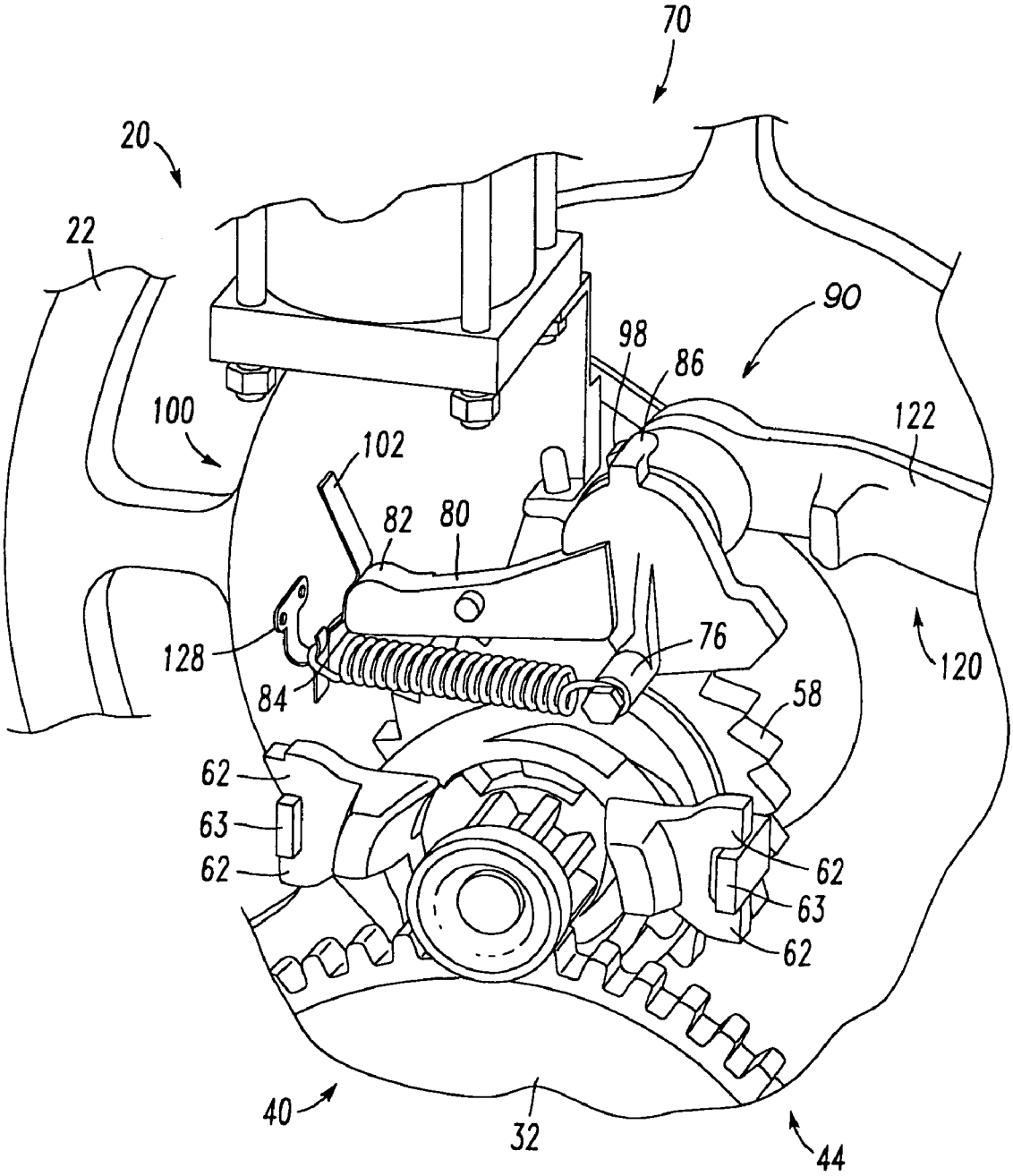
FIG. 5 is a cut-away perspective view of a hand brake assembly of the present invention, particularly showing the release lever of the present invention in the brake applied position.

A clutch and quick release mechanism 40 further comprises a release lever, generally designated 70, best seen in FIGS. 4, 5, and 6, having a shaft 72 journaled in a release shaft bushing 73 perpendicularly secured in housing front plate 16 above the driving mechanism 20. A release handle, generally designated 120, engages an external end of release shaft 72 while the other end of the release shaft 72 is provided with a main portion 74, thereby preventing axial displacement of release lever 70. A holding pawl, generally designated 90, is rotatably mounted on release shaft bushing 73 and engages ratchet wheel 58 and is free to ratchet thereon upon rotation of ratchet wheel 58 in a counter-clockwise direction, as viewed in FIG. 1.

Figure 7:
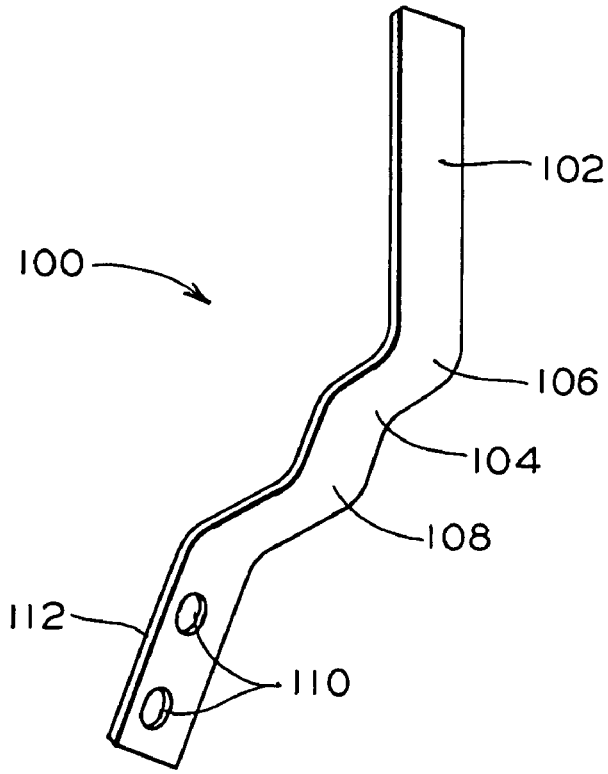
FIG. 7 is a perspective view of the leaf spring of the present invention.

A force receiving tab portion 86 cooperates with the force transmitting portion 98 of holding pawl 90 and is engaged by the force transmitting tab portion 98 during a brake application cycle. At least one detent retaining means 100, engages detent portion 82 of release lever 70 with the brake in the released and hold condition. In the presently preferred embodiment such at least one detent means 100 is a well known leaf spring, shown in FIGS. 4, 5 and 7, of a predetermined force to provide engagement of a release lever 70 while the brakes are in a released and hold condition while allowing release of the release lever 70 to apply brakes. As shown in FIG. 7, leaf spring 100 includes a ramp portion 102, a detent retaining portion 104, disposed between a first detent portion 106 and a second detent portion 108, and at least one cavity 110, disposed within mounting portion 112, for attachment to the hand brake housing 14. In the preferred embodiment, there are two mounting cavities for maintaining alignment of the leaf spring during engagement with the release lever.

Alternatively the detent means 100 can be a mechanical, pneumatic, hydraulic or electrical detent means mounted internally or externally of the hand brake housing 14. For example, detent means 100 can comprise a cylinder having a detent portion disposed at the end of the cylinder rod and receiving a fluid pressure signal to extend such rod in order to positively retain the release lever 70 and receiving yet another fluid pressure signal to retract the rod at the beginning of the brake application cycle. Alternatively, the cylinder can be an electrical solenoid having similar interfaces.

Additionally, the leaf spring 100 can be attached to the lever arm 80 and engage a member disposed in a predetermined position within housing 14.

At least one spring means 130 engages release lever portion 78 attached to the pin portion 76 at one end and engages a mounting hook 128 attached to housing 14 at the distal end. In the presently preferred embodiment such at least one spring means 130 is a simple compression spring.

In operation, in order to apply the brakes, hand wheel 22 is rotated counter-clockwise, as viewed in FIG.1, such rotation being transmitted through drive shaft 24, and pinion 30 to cause rotation of gear 32 in a counterclockwise rotation and thereby take-up slack of chain 37. Until such time that tension starts to build up in chain 37, shaft 24, pinion 30, nut 52, and clutch collar 48 all rotate as a unit during rotation of hand wheel 22. When the tension begins to build up in chain 37, such tension is reflected in gear 32 and is transmitted back through pinion 30 to the clutch collar 48. Resistance to rotation by clutch collar 48, which is splined to nut 52, causes nut 52 to advance on threads 25 and thereby clamp ratchet member 58 between the friction surfaces 56 and 57. With ratchet 58 so clamped, continued rotation of wheel 22 causes drive shaft 24, the ratchet member 58, and nuts 52 (along with friction plates 59) to rotate as a single unit until the desired tension is attained on chain 37, while holding pawl 90 ratchets on ratchet member 58. When desired tension has been achieved on chain 37, rotation or application of torque on wheel 22 is terminated, and the holding pawl 90 engaged on clamped ratchet member 58 prevents the chain from unwinding, since pawl 90 permits only counter-clockwise rotation of ratchet member 58. Once applied, the brakes may be released either gradually or quickly.

For providing a gradual release of the brakes, hand wheel 22 is turned counterclockwise slightly to partially loosen nut 52 and thereby reduce the clamping force on ratchet member 58, which is restrained from rotation by holding pawl 90. The initial counterclockwise rotation of hand wheel 22 effects a corresponding rotation of pinion 30 and gear 32, thereby easing the tension on chain 37. Continued counterclockwise rotation of hand wheel 22 effects complete release of the load on chain 37 with gear 32 continuing to rotate until winding drum 35 has taken up all chain slack, that is, the amount of chain that had been taken up during the brake-applying phase of operation. When all chain slack has been taken up, further rotation of gear 32, pinion 30 and nut 52 is terminated with the brakes fully released. Clockwise rotation of hand wheel 22 is limited by a drive shaft pin 60 which projects into a slot 61 formed in nut 52.

Figure 8:
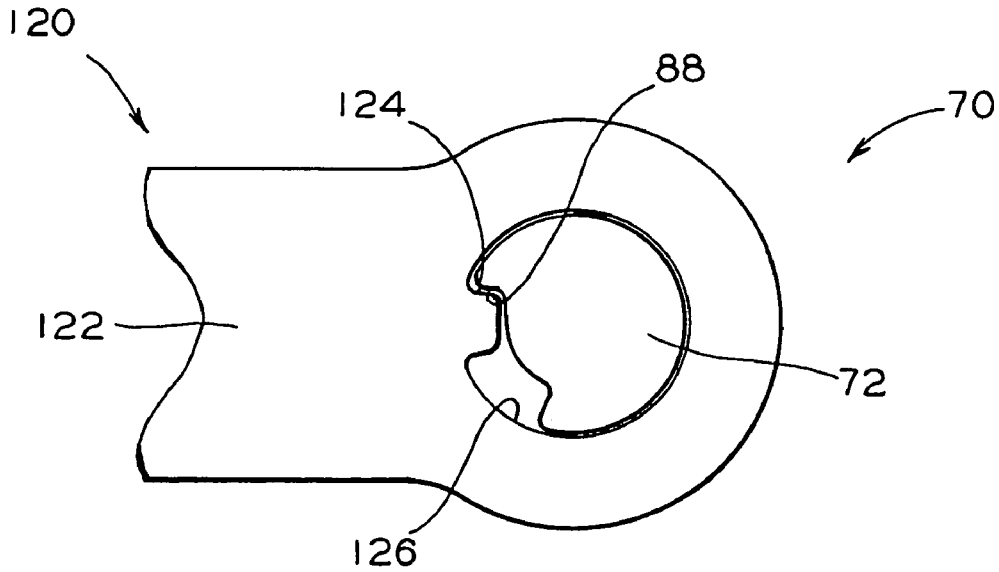
FIG. 8 is a partial planar view of the release shaft and release handle lever engagement of the present invention.

A quick release of the brake application is caused by rotating lever 122 of the release handle 120 (which is normally in an applied position) in a counter-clockwise direction, as viewed in FIG. 1. As shown in FIG. 8, release lever 122 having a force transmitting portion 124 is disposed within cavity 126 for engagement with a force receiving portion 88 disposed within the external end of the release shaft 72 for rotation of said release shaft 82 in a counter-clockwise direction, as viewed in FIG. 1.

Subsequent engagement of pin portion 76 with the second fork portion 49 of movable cam 44, causes clockwise rotation of such movable cam 44. As noted supra, stationary cam 42 and the movable cam 44 are provided with complementary fast-pitch threads 43, so that as movable cam 44 rotates clockwise, it moves axially outwardly of stationary cam 42, in an upwardly direction as viewed in FIG. 3, and carries with it clutch collar 48 by engagement of flange 50 thereof. A groove (not shown) in movable cam 44 serves to constrain the collar flange 50 from relative axial and lateral movement with respect to movable cam 44 but allows free clutch collar 48 rotation. Stationary cam 42 is restrained against both rotational and axial movement by engagement of lugs 62 formed on a periphery thereof and engaged in respective T-shaped elements 63 fixed to the inside surface of housing 14 (see FIG. 3).

Thus, upward axial movement of movable cam 44 causes an axial disengagement of external splines 64 formed on clutch collar 48 from internal splines 65 formed on pinion 30, thereby allowing the pinion 30 and gear 32 to rotate freely for releasing the load on chain 37, while drive shaft 24, nut 52, collar 48, and ratchet 58 are all held stationary by holding pawl 90.

Lever arm portion 80 of the release lever rotates counterclockwise subsequently with the rotation of release handle 120 with first round portion 84 engaging ramp portion 102 of leaf spring 100 for gradual engagement with leaf spring 120. Upon substantially reaching the end of the rotational travel, detent portion 82, having a predetermined profile substantially equal to predetermined profile of the retaining portion 104 of said leaf spring 100, engages retaining portion 104 for substantial retention of the release lever 70 in the release and hold position. Such retention of release lever 70 prevents its rotating in a clockwise direction toward the applied position and further prevents rotation of the gear 32 and, more particularly, prevents partial release of the chain 37 so that motion of the railway vehicle around the curve will not cause unintended brake application due to the partially released chain 37 not having enough slack to withstand railway vehicle motion.

When the brakes are fully released, the operator allows release handle 120 to return by gravity to the "applied" position from which the brakes may again be applied if desired.

Thus, the present invention has been described in such full, clear, concise and exact terms as to enable any person skilled in the art to which it pertains to make and use the same. It will be understood that variations, modifications, equivalents and substitutions for components of the specifically described embodiments of the invention may be made by those skilled in the art without departing from the spirit and scope of the invention as set forth in the appended claims.

We claim:

1. In a handbrake mechanism, where a hand wheel is used to rotate a gear wheel to apply brakes on a railway car, having a housing with a back wall and a front wall, with a chain winding drum and a main gear wheel rotatably mounted on a drum shaft thereon, a hand wheel shaft rotatably mounted on said housing having a bearing section at a first end and a hand wheel receiving section on a second end external to said housing, a ratchet wheel rotatable with said hand wheel shaft intermediate said first and second ends thereof, a holding pawl in said housing which cooperates with said ratchet wheel so as to prevent reverse rotation thereof, a freely rotatable pinion on said hand wheel shaft and engaging said main gear wheel, said pinion having a radially extending flange cooperating therewith, a disengageable driving connection between said flange and said ratchet wheel, a quick release mechanism which cooperates with said holding pawl to allow reverse rotation of said ratchet wheel for releasing said chain, said quick release mechanism having a manually operable quick release handle, the improvement comprising:

(a) a substantially cylindrical shaft portion rotatably mounted in said housing, said shaft portion having one end thereof extending outwardly past exterior surface of said housing for operable engagement with said quick release handle;

(b) a cam engaging portion extending outwardly from said shaft portion and selectively engaging a first fork portion and a second fork portion of a movable cam of said handbrake mechanism for effecting rotational motion of said movable cam;

(c) a spring engaging portion disposed adjacent a distal end of said cam engaging portion for engagement with at least one spring;

(d) a lever arm portion extending outwardly and perpendicular to said substantially cylindrical shaft portion;

(e) a detent portion disposed within a distal end of said lever arm portion;

(f) a force receiving means disposed within said one end of said shaft portion extending outwardly past said exterior surface of said housing for enabling rotation of said shaft portion upon rotational movement of said quick release handle;

(g) a force receiving tab portion in operable engagement with a force transmitting tab portion formed on said holding pawl for applying a force generated by rotation of said holding pawl onto said lever arm portion; and (h) a leaf spring disposed within said housing, said leaf spring including:

(i) a mounting portion for engagement with an interior surface of said housing of said hand brake, (ii) at least one mounting cavity disposed within said mounting portion for enabling attachment of said leaf spring to said substantially rigid housing surface of said hand brake, (iii) a ramp surface portion for providing substantially gradual engagement between said leaf spring and said detent portion of said arm portion, (iv) a first detent portion disposed substantially adjacent said ramp portion, (v) a second detent portion disposed substantially adjacent said mounting portion, and (vi) a retaining portion disposed between said first detent portion and said second detent portion and operably engaging said cooperating detent portion of said lever arm portion for retaining said hand brake in a release and hold position.

2. In a handbrake mechanism for railway car as described in claim 1, wherein said retaining portion is substantially concave.

3. In a handbrake mechanism for railway car as described in claim 2, wherein said detent portion of said arm portion is substantially convex, and wherein said substantially concave retaining portion has a predetermined diameter being substantially equal to a predetermined diameter of said cooperating substantially convex detent portion.

4. In a handbrake mechanism for railway car as described in claim 1, wherein said ramp portion is disposed angularly in relationship to said mounting portion for effecting gradual engagement of said detent portion of said arm portion.

5. In a handbrake mechanism for railway car as described in claim 1, wherein said leaf spring has predetermined hardness to prevent disengagement of said detent portion of said arm portion during vibration caused by railway car motion.

6. In a handbrake mechanism for railway car as described in claim 1, wherein two mounting cavities are provided for maintaining alignment of said leaf spring during engagement with said detent portion of said arm portion.

7. A unitary device for a quick release mechanism in a railcar hand brake having a housing with a back wall and a front wall, with a chain winding drum and a main gear wheel rotatably mounted on a drum shaft thereon, a hand wheel shaft rotatably mounted on said housing having a bearing section at a first end and a hand wheel receiving section on a second end external to said housing, a ratchet wheel rotatable with said hand wheel shaft intermediate said first and second ends thereof, a holding pawl in said housing which cooperates with said ratchet wheel so as to prevent reverse rotation thereof, a freely rotatable pinion on said hand wheel shaft and engaging said main gear wheel, said pinion having a radially extending flange cooperating therewith, a disengageable driving connection between said flange and said ratchet wheel, a quick release mechanism which cooperates with said holding pawl to allow reverse rotation of said ratchet wheel for releasing a chain, said quick release mechanism having a manually operable quick release handle, said device comprising:

(a) a release shaft portion rotatably mounted in said housing, said release shaft portion having a first end thereof extending outwardly past exterior surface of said housing for operable engagement with said quick release handle;

(b) a cam engaging portion extending coaxially from an opposed second end of said release shaft portion toward a movable cam of said hand brake mechanism and selectively engaging a first fork portion and a second fork portion of said movable cam for effecting rotational motion of said movable cam;

(c) a lever arm portion extending outwardly and perpendicular to said release shaft portion;

(d) a detent portion formed within a distal end of said lever arm portion; and (e) a force receiving means disposed within said one end of said shaft portion extending outwardly past said exterior surface of said housing for enabling rotation of said shaft portion upon rotational movement of said quick release handle; and (f) a force receiving tab portion formed on said opposed second end of said release shaft portion in operable engagement with a force transmitting tab portion formed on said holding pawl for applying a force generated by rotation of said holding pawl onto said lever arm portion.

8. The device, according to claim 7, wherein a shape of said first end of said release shaft portion is substantially cylindrical.

9. The device, according to claim 7, wherein said force receiving tab portion has an elongated shape and is disposed generally coaxially to said release shaft portion.

10. The device, according to claim 7, wherein said detent portion has a generally convex shape.

11. The device according to claim 7, wherein said force receiving means is a cavity of a predetermined size and shape.

12. The device according to claim 11, wherein said cavity is a notch disposed on the circumference of and longitudinally along the axis of said release shaft portion.

13. A release holding mechanism for a quick release apparatus in a railcar hand brake having a housing, said housing having a front casing with an inside wall of a predetermined size and shape, a back plate, an operating shaft rotatably mounted in said housing, said operating shaft including a first end and a second end and further including a ratchet wheel rotatable with said operating shaft intermediate said first and second ends thereof, and a release shaft rotatably mounted in said housing; said release holding mechanism comprising:

(a) a member disposed substantially perpendicular to and about the circumference of said release shaft;

(b) a detent portion formed on a distal end of said member;

(c) a force receiving tab disposed coaxially with said release shaft and in operable engagement with a force transmitting tab portion formed on a holding pawl to enable application of a load on said chain mechanism; and (d) a flexible clamp of a predetermined size and shape disposed inside said housing.

14. The release holding mechanism, according to claim 13, wherein said flexible clamp is a spring clip.

15. The release holding mechanism, according to claim 14, wherein said spring clip includes:

(a) a mounting portion for engagement with a substantially rigid housing surface of said hand brake, (b) at least one mounting cavity formed through said mounting portion for enabling attachment of said spring clip to a substantially rigid housing surface of said hand brake;

(c) a ramp surface portion for providing substantially gradual engagement between said spring clip and said detent portion;

(d) a first detent portion disposed substantially adjacent said ramp portion;

(e) a second detent portion disposed substantially adjacent said mounting portion; and (f) a retaining portion disposed between said first detent portion and said second detent portion an operably engaging said cooperating detent portion of said member for retaining said quick release mechanism in a release and hold position.

* * * * *